United States Patent [19]

Trocino

[11] 4,411,718

[45] Oct. 25, 1983

[54] LIQUID EXPLOSIVE COMPOSITIONS FOR FIELD OPERATIONS

[76] Inventor: Joseph L. Trocino, 15233 Ventura Blvd., P-8, Sherman Oaks, Calif. 91403

[21] Appl. No.: 314,677

[22] Filed: Oct. 26, 1981

[51] Int. Cl.[3] ..... C06B 47/04

[52] U.S. Cl. ..... 149/74; 149/89; 149/90

[58] Field of Search ..... 149/74, 89, 90

[56] References Cited

U.S. PATENT DOCUMENTS

| | | | |
|---|---|---|---|
| 3,419,444 | 12/1968 | Minnick | 149/89 |
| 3,471,347 | 10/1969 | Abraham et al. | 149/89 |
| 3,925,124 | 12/1975 | Tannenbaum | 149/89 |
| 4,334,939 | 6/1982 | Bushman | 149/89 |

*Primary Examiner*—Stephen J. Lechert, Jr.
*Attorney, Agent, or Firm*—Roger A. Marrs

[57] ABSTRACT

Explosive compositions prepared from commercially available nitric acid and a common industrial solvent are disclosed herein which exhibit exceedingly high blasting strengths. The compositions are relatively more stable than conventional shaped charge explosives such as HMX or RDX and far less expensive.

6 Claims, 1 Drawing Figure

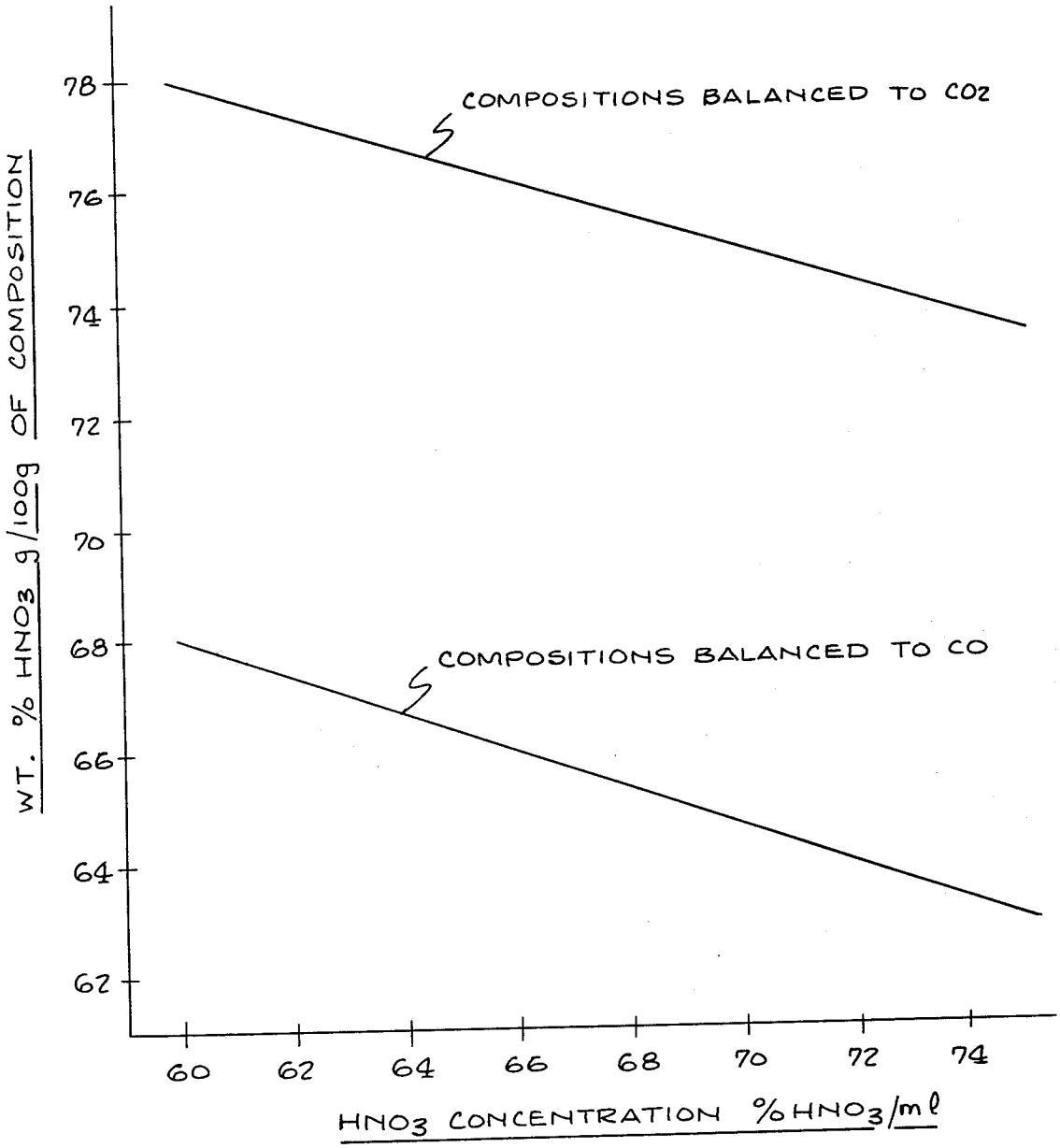
COMPOSITIONS BALANCED TO CO2
COMPOSITIONS BALANCED TO CO
WT. % HNO3 g/100g OF COMPOSITION
78
76
74
72
70
68
66
64
62
60
62
64
66
68
70
72
74
HNO3 CONCENTRATION % HNO3/ml

LIQUID EXPLOSIVE COMPOSITIONS FOR FIELD OPERATIONS

BACKGROUND OF THE INVENTION

1. Field of the Invention

This invention relates generally, to the preparation of blasting compositions and more specifically to the preparation of liquid explosive compositions from sensitized nitroparafins which may be utilized in numerous applications requiring personal safety and high blasting efficiency.

2. Brief Description of the Prior Art

There have been numerous attempts to provide explosive or blasting compositions, for industrial and military applications, that exhibit high blasting efficiencies with a minimum risk of injury to the users. Factors such as detonation sensitivity, shipment, and storage of the compositions have tended to reduce the number of practical compositions that are commercially available. Conventional shaped charge explosives, such as HMX and RDX are relatively expensive and are limited in their usefulness because they are solids.

Attempts to prepare liquid or semi-liquid blasting sompositions from nitroalkanes have met with some success as illustrated in: U.S. Pat. No. 3,132,060; U.S. Pat. No. 3,133,844; U.S. Pat. No. 3,242,022; U.S. Pat. No. 3,442,728; and U.S. Pat. No. 3,454,438. However, in each instance the patented composition has been limited in its usefulness because it was either too complex or, it contained undesirable ingredients from a cost or availability point of view, it was so sensitive that it had to be mixed on site from ingredients that were transported separate in special equipment or, because of its composition, it was not capable of yielding a reproducible smooth uniform detonation front.

Of the patents cited above, U.S. Pat. No. 3,454,438 contains a disclosure of compositions which appear to be most relevant to the present invention. However, the compositions of the "438" patent are not as useful as the present invention because the compositions either are too complex and not reliable, they require exceedingly expensive ingredients, they contain relatively hazardous materials, or because of their sensitivities, they are less safe to use. Thus, there is still a need for a low cost, non-hazardous efficient and reliable liquid explosive composition that can be blended and used without special equipment.

SUMMARY OF THE INVENTION

A general purpose of this invention is to provide liquid explosive or blasting compositions that are suitable for non-military as well as military applications. In accomplishing this purpose, I have discovered that nitropropane may be blended with commercial grade nitric acid in selected proportions to yield low cost, stable, highly efficient, relatively safe and simple to prepare, liquid explosive compositions.

It is, therefore, one objective of this invention to provide liquid explosive compositions that contain low cost commercially available ingredients. Another objective of this invention is to provide highly efficient blasting compositions that are relatively easy to use with a minimum safety hazard. And, a further objective of this invention is to provide liquid blasting compositions which yield a uniformly smooth detonation front.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a plot of the weight of $HNO_3$, in grams, per 100 grams of blasting composition as a function of acid concentration in aqueous $HNO_3$ solutions.

DESCRIPTION OF THE PREFERRED EMBODIMENT

The explosive compositions of my invention consist of a common industrial solvent, nitropropane, selectively sensitized with commercial grade nitric acid.

Nitropropane is an industrial solvent that is available in abundant supply at low cost. It comes as 1-nitropropane, 2-nitropropane or as a mixture of 1-nitropropane and 2-nitropropane. The physical properties of nitropropane are such that it is inherently much safer to use than a large number of solvents commonly used in coatings. For example, its lower limit of flammability is 2.6% by volume in air as compared with 0.9%, 1.0% and 2.15% for methyl isobutyl ketone, xylene and acetone respectively. Similarly, its flash point (TCC) is 82°-96° F. as compared to flash points of 0° F., 24° F. and 81° F. for acetone, methyl ethyl ketone and sylene respectively.

Commercial grade nitric acid is similarly an abundant, readily available low cost material. The nitric acid found to be useful as a sensitizer for nitropropane is aqueous nitric acid which contains from 60 to 75% nitric acid. It may be transported and shipped with little or not difficulty using ordinary precautions.

To prepare suitable explosive mixtures with nitropropane ($C_3H_7NO_2$) and nitric acid ($HNO_3$), I have discovered that the ratio of anhydrous $HNO_3$ to $C_3H_7NO_2$ within the composition must fall within 1.273:1 and 2.122:1. These ratios are easily prepared by selectively blending $C_3H_7NO_2$ with commercially available aqueous $HNO_3$, containing from 25 to 40% water.

The most effective compositions are obtained when the ratio of $HNO_3$ to $C_3H_7NO_2$ is such that the combustion product yields carbon dioxide as opposed to carbon monoxide. For example, $C_3H_7NO_2+3HNO_3 \rightarrow 3CO_2+5H_2O-2N_2$ (1). However, compositions containing a $HNO_3$:$C_3H_7NO_2$ ratio which yields a combustion product containing carbon monoxide, i.e. $C_3H_7NO_2+1.8HNO_3-3CO+4.4H_2O+1.4N_2$ (2) are also useful.

The amount of $HNO_3$ per 100 grams of composition required to yield the combustion products of equations (1) and (2) may be selected from the curves in FIG. 1 if the concentration or density of the acid solution is know. For example, using a commercially available $HNO_3$ solution containing 65% $HNO_3$, one would either blend 76.5 grams or 66.2 grams of the solution with 23.5 grams or 33.8 grams of $C_3H_7NO_2$ respectively depending upon whether the mixture is to be balance to $CO_2$ or to CO. Compositions balanced to $CO_2$ are more sensitive and exhibit higher detonation velocities than compositions balanced to CO.

In practice, one merely mixes the proper weight of $HNO_3$ and $C_3H_7NO_2$ in a clean container as the explosive composition is needed. Nitropropane is totally missible in aqueous nitric acid solutions over a wide temperature range so long as the acid content of solution is at least 60%. Nitropropane is immiscible with $HNO_3$ in concentrations less than 58.0% acid. Above 75.0% acid, the advantages of the compositions, insofar as safety factors are concerned, are lost because the sensitivity of the compositions increase dramatically.

Selected compositions, balanced to $CO_2$, are shown below for five acid solutions.

TABLE 1

Nitropropane-Nitric Acid Compositions Balanced to $CO_2$

| Ingredient | Acid Concentration, % $HNO_3$ 60.0% | 63 | 65 | 70 | 75 |
|---|---|---|---|---|---|
| $C_3H_7NO_2$, wt % | 22.04 | 22.89 | 23.45 | 24.80 | 26.11 |
| $HNO_3$, wt % | 77.96 | 77.11 | 76.55 | 75.20 | 73.89 |
| GAP(1) | | | 0.47 | .92 | |
| DV(2) | 6280 | | 6441 | 6584 | |

(1)Gap sensitivity test 50% "go" thickness in inches. HMX is 2.8 inches and RDX is 2.7 inches, when pressed to a density of 1.1 g/sec.

(2)Detonation velocity, meters per second. Nitromethane = 6200 m/sec while RDX detonates with a velocity of 7960 m/sec. It is understood, by those skilled in the art, that there is water in each of the compositions shown in Table 1. Should one recalculate the anhydrous acid content, the following specific concentrations would be apparent:

TABLE 2

Nitropropane-Nitric Acid Compositions

| Ingredient | Acid Concentration, % $HNO_3$ 60 | 65 | 70 | 75 |
|---|---|---|---|---|
| $C_3H_7NO_2$, wt % | 22.04 | 23.45 | 24.80 | 26.11 |
| $HNO_3$, wt %(1) | 46.78 | 49.76 | 52.64 | 55.42 |
| $H_2O$, wt % | 31.18 | 26.79 | 22.56 | 18.47 |

(1)Anhydrous $HNO_3$.

Similarly, the specific composition of mixtures balanced to CO are shown in the following table:

TABLE 3

CO Balanced Nitropropane-Nitric Acid Compositions

| Ingredient | Acid Composition, % $HNO_3$ 60 | 65 | 70 | 75 |
|---|---|---|---|---|
| $C_3H_7NO_2$, wt % | 32.03 | 33.80 | 35.48 | 37.07 |
| $HNO_3$(1), wt % | 40.78 | 43.03 | 45.17 | 47.20 |
| $H_2O$, wt % | 27.19 | 23.17 | 19.35 | 15.73 |

(1)Anhydrous $HNO_3$.

The simplicity of this invention is apparent from the above teachings. Inasmuch as the total number of components, within any mixture, is reduced, there is little or no chance for blending mistakes by operators using the compositions under field conditions. The relatively insensitivity of the compositions renders them safe for use by persons having ordinary skills, and the insensitivity of the components of the composition makes transportation and shipment a simple task. Therefore, having disclosed the nature of my invention, and having provided teachings to enable others to make and use the same, the scope of my claims may now be understood. While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

I claim:

1. A completely liquid explosive composition consisting of 22.0 to 37.1% nitropropane blended with 62.9 to 78.0 nitric acid wherein said acid contains from 25.0 to 40.05% water and wherein said nitropropane is a mixture of 1-nitropropane and 2-nitropropane.

2. A composition in accordance with claim 1 wherein:

22.0 to 32.0% nitropropane is blended with 73.9 to 78.0% nitric acid wherein said acid contains 40.0% water.

3. A composition in accordance with claim 1 wherein:

26.1 to 37.1% nitropropane is blended with 62.9 to 70.0% nitric acid wherein said acid contains 25.0% water.

4. An inexpensive, stable liquid explosive composition for use in field operations comprising 22.0 to 37.1% nitropropane mixed with 40.7 to 55.5% nitric acid and 15.7 to 31.2% water wherein said nitropropane consists of a mixture of 1-nitropropane and 2-nitropropane in any proportions and said nitric acid is anhydrous nitric acid.

5. A composition of claim 4 wherein: 32.0 to 37.1% nitropropane is blended with 40.8 to 47.2% nitric acid and 15.7 to 27.2% water.

6. A composition of claim 4 wherein:

22.0 to 26.1% nitropropane is blended with 46.8 to 55.4% nitric acid and 18.5 to 31.2% water.

* * * * *